US007275802B2

(12) United States Patent
Berardelli et al.

(10) Patent No.: US 7,275,802 B2
(45) Date of Patent: Oct. 2, 2007

(54) CLEANER

(75) Inventors: David Berardelli, San Diego, CA (US); Antoni Murcia, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 331 days.

(21) Appl. No.: 11/072,803

(22) Filed: Mar. 3, 2005

(65) Prior Publication Data

US 2006/0197797 A1 Sep. 7, 2006

(51) Int. Cl.
*B41J 2/165* (2006.01)
*B41J 2/14* (2006.01)

(52) U.S. Cl. ..... 347/22; 347/29; 347/32; 347/33; 347/35; 347/36; 347/53

(58) Field of Classification Search ..... 347/22–35, 347/53

See application file for complete search history.

(56) References Cited

U.S. PATENT DOCUMENTS 5,563,639 A 10/1996 Cameron
5,742,303 A 4/1998 Taylor
5,870,115 A * 2/1999 Kikuchi et al. ..... 347/32
6,095,635 A 8/2000 Kinoshita
6,398,335 B1 6/2002 Benjamin
6,517,185 B1 2/2003 Aldrich
6,565,189 B2 5/2003 Yamada
6,601,942 B2 8/2003 Taylor
6,746,099 B2 6/2004 Smith
6,755,503 B2 * 6/2004 von Niederhausern et al. ..... 347/33
6,820,961 B2 * 11/2004 Johnson ..... 347/36
2001/0038400 A1 11/2001 Yamada
2002/0008727 A1 1/2002 Taylor
2002/0158941 A1 10/2002 Vega
2003/0112290 A1 6/2003 Spitz
2003/0142150 A1 7/2003 Barton
2004/0001119 A1 1/2004 Johnson
2004/0061745 A1 4/2004 Salzer
2004/0075702 A1 4/2004 Waller

OTHER PUBLICATIONS

International Search Report for PCT/US2006/007948, dated Jul. 25, 2006, 4 pages.

* cited by examiner

*Primary Examiner*—Shih-Wen Hsieh
(74) *Attorney, Agent, or Firm*—Robert D. Wasson

(57) ABSTRACT

Embodiments of a cleaner are disclosed.

27 Claims, 6 Drawing Sheets

CLEANER

BACKGROUND

The quality of inkjet printing may sometimes be favorably affected by servicing inkjet printheads. Devices for servicing printheads are sometimes large and may permit undesirable quantities of aerosol to escape from the device for servicing the printheads. Moreover, in some applications securing a device for servicing a printhead may be difficult.

DETAILED DESCRIPTION OF THE DRAWINGS

Figure 1:
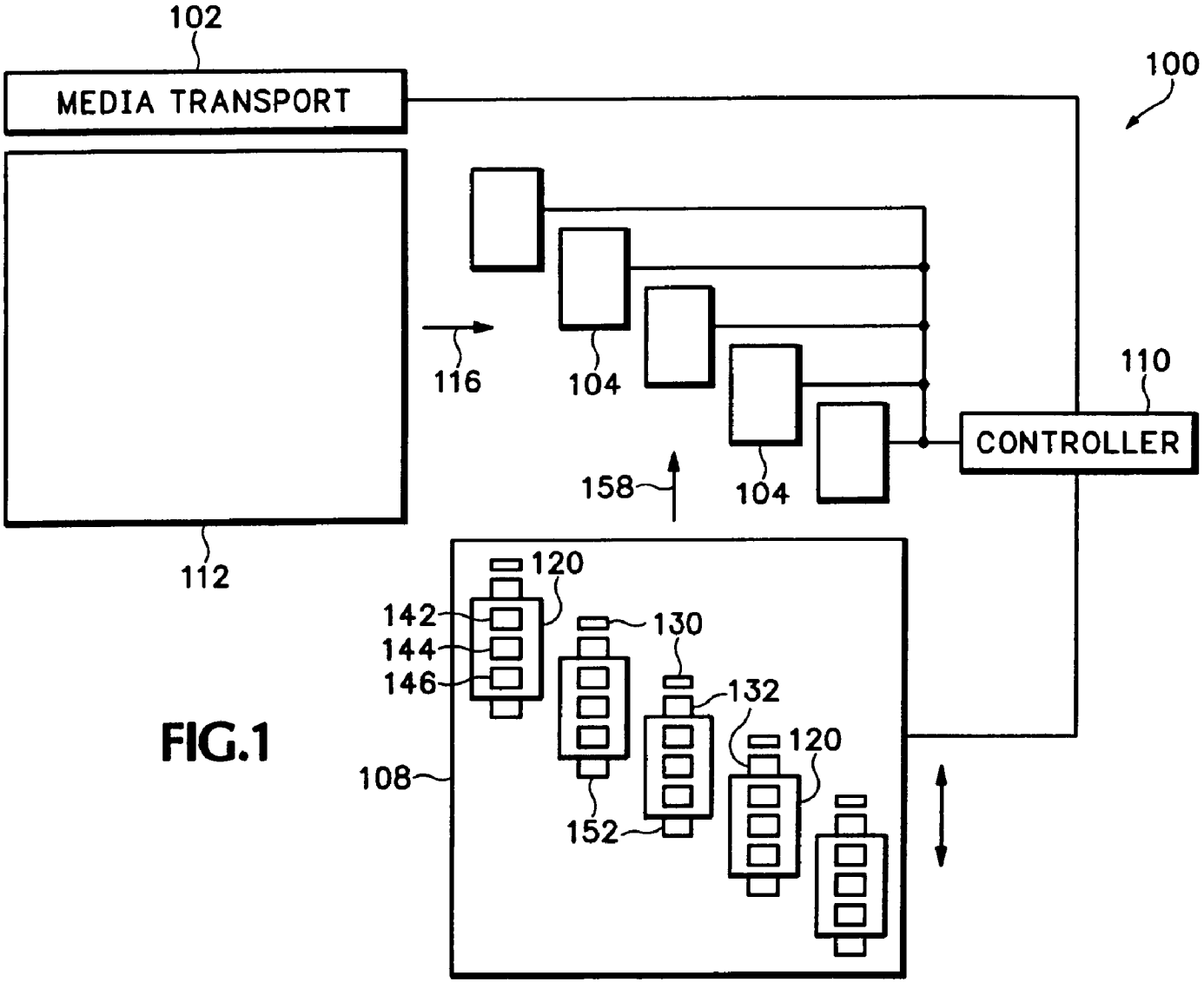
FIG. 1 schematically illustrates an imaging device according to an example embodiment.

FIG. 1 schematically illustrates a portion of imaging device 100, according to an example embodiment. In this example embodiment, the imaging device 100 includes a media transport mechanism 102, printheads 104, and a carriage 108. The media transport mechanism 102, the printheads 104, and the carriage 108, operate under control of a suitable controller 110.

The controller 110 operates to cause the media transport mechanism 102 to advance media 112 in the direction of arrow 116 through a printzone adjacent the printheads 104. The media 112 may comprise, for example, paper, transparencies, Mylar, cardboard, or other suitable media. As the media 112 advances adjacent the printheads 104, one or more of the printheads eject fluid, such as ink, an adhesive, or other suitable fluid, onto the media 112. The printheads 104 eject fluid onto the media 112 in response to control signals received from the controller 110.

The printheads 104 are illustrated as being stationary in that the printheads 104 do not move significantly while ejecting fluid onto the media 112. Rather, the printheads 104 remain in a generally fixed position while the media 112 passes adjacent the printheads 104. As shown in FIG. 1, the printheads 104 may be arranged in staggered fashion such that there is some overlap between the printheads 104 in the direction of media movement 116. This printhead configuration may be referred to as a "page wide array" of printheads since the printheads 104 may have an overall dimension that spans an entire width of the media 112. In some embodiments, however, the printheads 104 may be configured differently. For example, the printheads 104, in some embodiments, may not span an entire width of the media 112. The printheads 104, in some embodiments, may lie in a common horizontal plane and, in other embodiments, may lie in a common vertical plane. Pursuant to other embodiments, however, the printheads 104 may be arranged in arcuate, or some other non-planar, fashion. With reference to FIG. 1, in some embodiments, the printheads 104 may be configured to move in a direction normal to the page for adjusting printhead to media spacing, for servicing, or both.

The controller 110 generally comprises a processing unit configured to direct the operation of one or more components of imaging device 100. For purposes of the disclosure, the term "processing unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described.

Controller 110 is not limited to any specific combination of hardware circuitry and software, or to any particular source for the instructions executed by the processing unit. In some embodiments, the controller 110 controls operation of the media transport 102, the printheads 104, and the carriage 108. Instructions for performing the methods disclosed herein may be stored in computer readable media, such as in the form of firmware, at the controller 110.

Cleaners 120 are shown as being positioned at the carriage 108. As shown in FIG. 1, the carriage 108 supports members 130. The members 130 may comprise magnets in some embodiments and, in other embodiments, the members 130 may be formed of a magnetic material. The members 130 may be used, in some embodiments, for securing a cleaner 120 to the carriage 108 via magnetic force. One or more of the cleaners 120 may include a member 132, which may comprise a magnet or a magnetic material. In embodiments where the members 130 comprise magnets, the members 132 are formed of a magnetic material. Likewise, in embodiments where the members 130 are formed of a magnetic material, the members 132 may comprise magnets. As such, when the cleaners 120 are positioned such that the members 132 are adjacent corresponding members 130, a magnetic force between the corresponding members 130 and 132 secures the cleaner 120 to the carriage 108.

Figure 4:
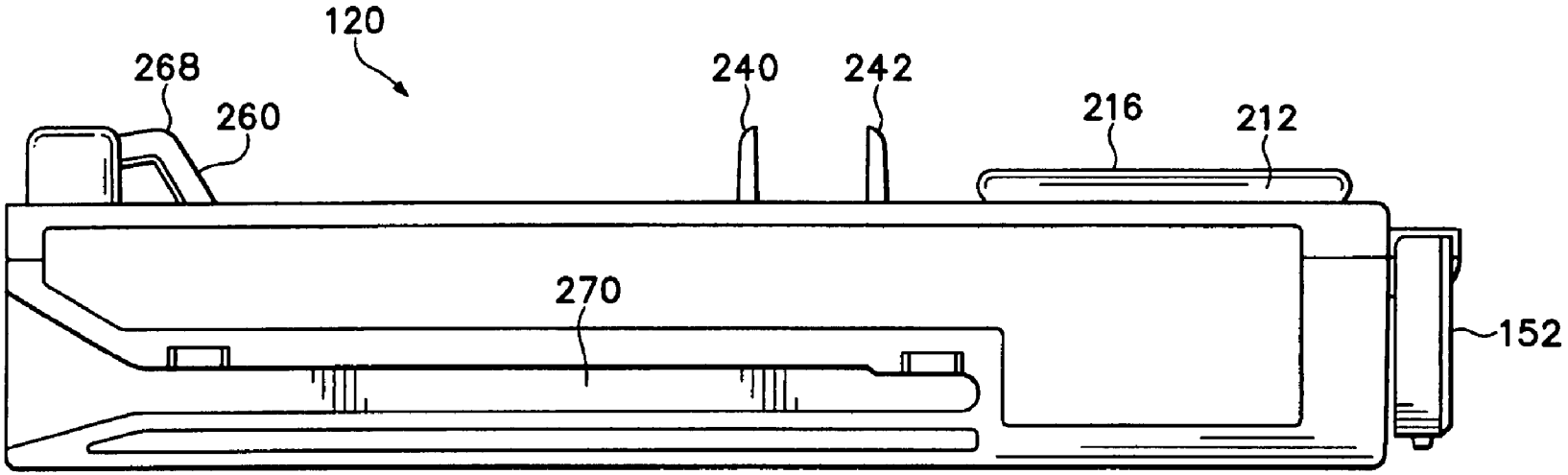
FIG. 4 is a side elevation view of the printhead cleaner of FIG. 2 according to an example embodiment.
Figure 5:
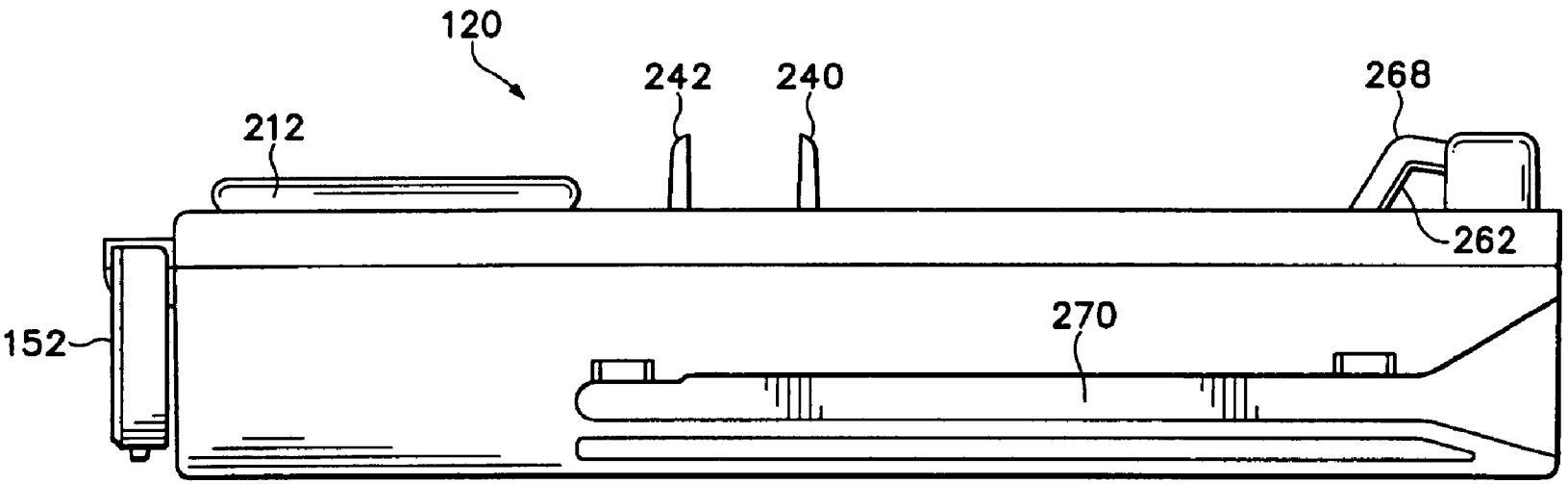
FIG. 5 is a side elevation view of the printhead cleaner of FIG. 2 according to an example embodiment.

In addition, and as discussed below, the cleaners 120 may optionally include grooves (FIGS. 2, 4, 5) formed in the sides thereof that engage with the carriage 108 to datum the cleaners 120 within the carriage 108. The carriage 108 may include protrusions that engage the grooves formed in the sides of the carriage to aid in maintaining and positioning the cleaner within the carriage 108.

The cleaners 120 may be oriented differently in different embodiments. For example, in embodiments where the printheads 104 lie in a common vertical plane and eject fluid, such as ink, in a substantially horizontal direction, the cleaners 120 may also be oriented vertically. In a specific example, the cleaners 120 may be vertically arranged such that the handle 152 is oriented with the handle 152 on top and the member 132 on bottom. In this configuration, the member 132 is at an end of the cleaner 120 that faces the direction of gravity and the handle 152 is at an opposite end of the cleaner that faces away from the direction of gravity. When the cleaner 120 is disposed in this position, fluid may pool in pocket region 634 (FIG. 6) of the cavity 208.

The cleaners 120, in the embodiment shown in FIG. 1, also include a capping device 142, a wiping station 144, and a spitting station 146. As the carriage 108 moves in the direction 158, the cleaners 120 each pass adjacent, or under, an associated one of the printheads 104. Also, as the carriage 108 moves in the direction 158, one or more of the cleaners 120 service one or more of the printheads 104. The cleaners 120 are arranged in a staggered configuration that substantially matches the staggered configuration of the printheads 104. The printheads 104 are capped at the capping device 142 and are wiped at the wiping station 144. The printheads 104 may also perform a spitting operation at the spitting station 146. To reduce aerosol from escaping the spitting station 146, a shield (not shown) may be formed about the perimeter of the spitting station 146 to engage, or come close to, the associated printhead 104 during spitting. Additional details regarding the shield are described below.

Each of the cleaners 120 are also shown as including a handle 152 that is configured to pivot or fold. In particular, to reduce the effective length of the cleaner 120, the handle 152 is secured to the cleaner 120 in a pivotable, or rotatable, fashion to permit the handle 152 to be pivoted or rotated to a folded position during operation of the device 100. The handle 152 may also be pivoted, or rotated, to an un-folded, or extended position for manual gripping during insertion or removal of the cleaner 120 from the carriage 108.

FIGS. 2-7 illustrate an example embodiment of a cleaner 120 including capping device 142, wiping station 144, and spitting station 146. The cleaner 120 includes a body 202 that may comprise a molded plastic component, although the construction and material of the body 202 may vary.

Figure 2:
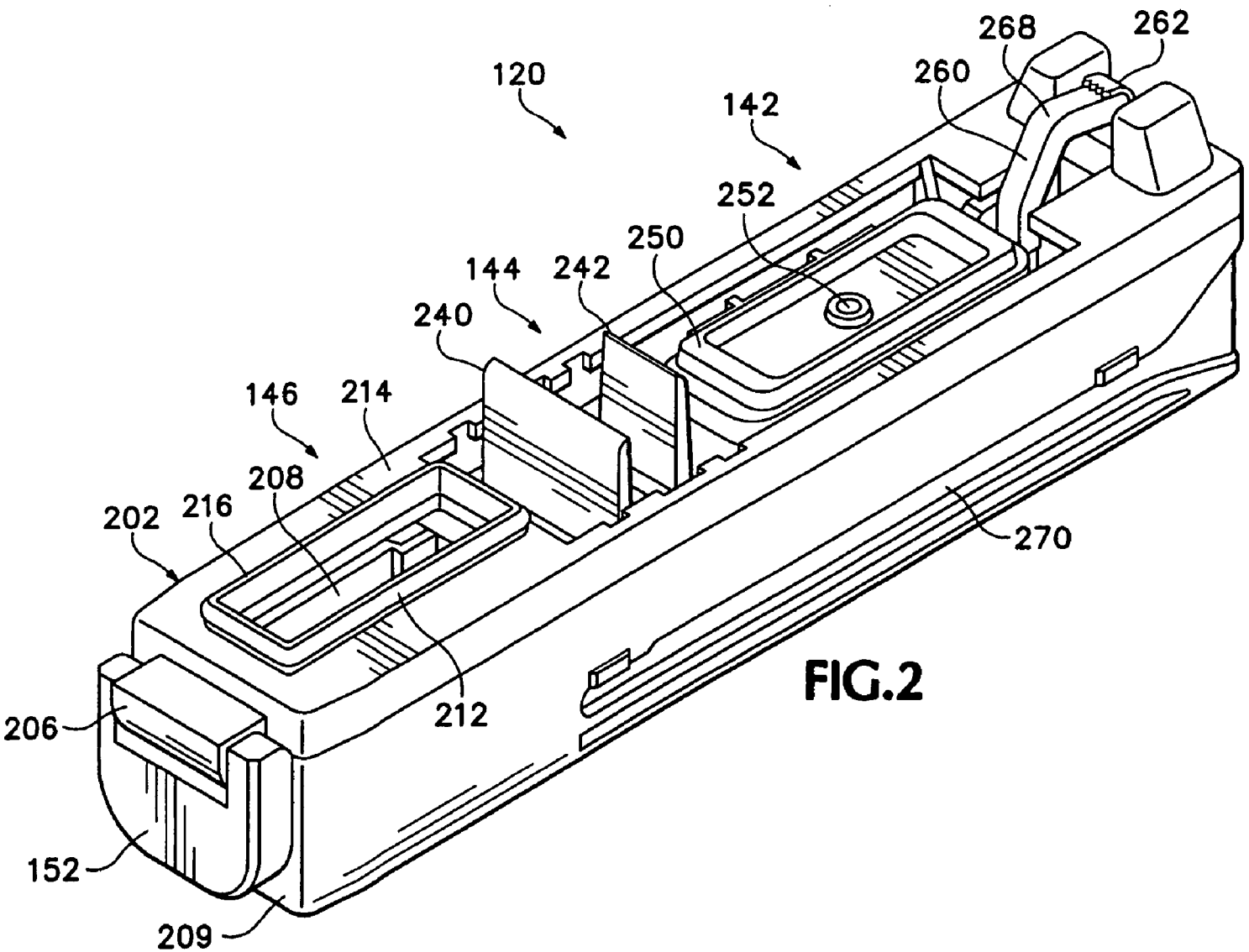
FIG. 2 is a perspective view of a printhead cleaner according to an example embodiment.
Figure 7:
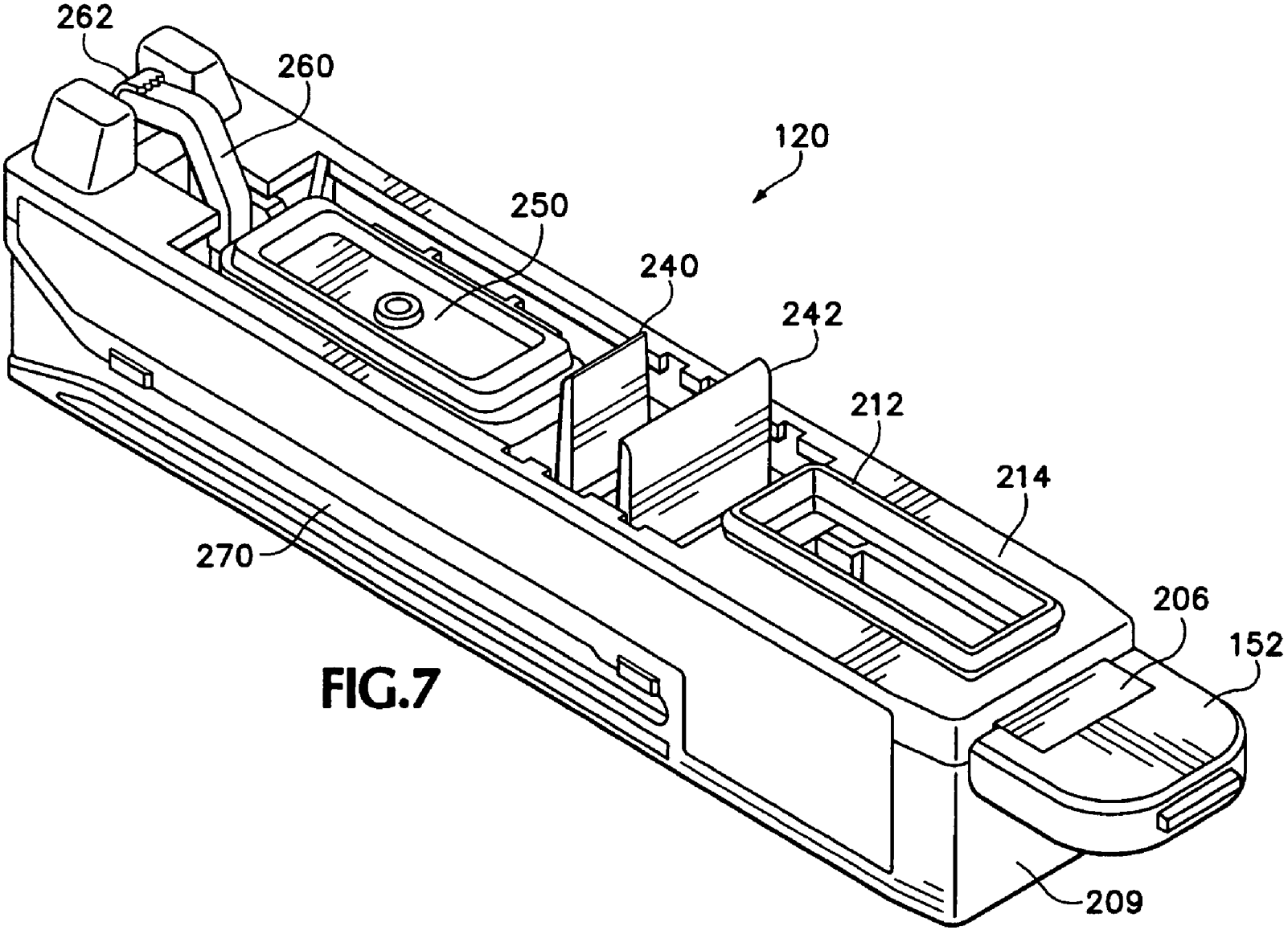
FIG. 7 is a perspective view of the printhead cleaner of FIG. 2 with the handle in an extended position, according to an example embodiment.

The handle 152 is shown as being pivotally secured to the body 202. In the example embodiment illustrated, protrusion 206 extends from side 209 of the body 202 and may be integrally formed with the body 202. The handle 152 is pivotally attached to the protrusion 206 by pin 204 (FIG. 3) such that the handle pivots or rotates about axis 210. In FIG. 2, the handle 152 is shown in a folded position. The handle 152 may also be rotated relative to the body 202 such that the surface 212 of the handle 152 is substantially parallel to surface 214 of the body 202. FIG. 7 illustrates the handle 152 in the extended or un-folded position. In the extended position, the handle 152 may be manually gripped and pulled to remove the cleaner 120 from the carriage 108 (FIG. 1).

Grooves 270 may be optionally formed in opposing sides of the cleaner 120. The grooves 270 may be configured to engage with the carriage 108 to serve as a datum structure to aid in positioning the cleaners 120 within the carriage 108. The carriage 108 may include protrusions (not shown) that engage the grooves formed in the sides of the carriage to aid in maintaining and positioning the cleaner within the carriage 108.

The spitting station 146 includes a spittoon cavity 208 formed in the body 202. The cavity 208 may or may not include optional absorbent material 218, such as foam in the cavity. The cavity 208 is open at surface 214 of the body 202. A shield 212 is positioned about the opening at the surface 214 and, in some embodiments, extends about an entire circumference of the opening. The shield 212 may be constructed as a resilient, compliant, member and may be formed of an elastomer, such as EPDM (Ethylene Propylene Diene monomer). In some embodiments, the material from which the shield is formed has a Shore A Scale hardness in the range of 35-80. In other embodiments, the material from which the shield is formed has a Shore A Scale hardness in the range of 70-80. Forming the shield 212 as set forth above, may provide a shield 212 that is sufficiently compliant such that the printhead 104 is not substantially damaged, in some embodiments, if the printhead 104 contacts the shield during servicing.

A lip 220 (FIG. 3) of the body 202 engages a ridge 222 (FIG. 3) formed adjacent an end of the shield 212. In the embodiment shown in FIG. 2, the shield 212 is held in the opening formed in surface 214 by engagement of the ridge 222 and the lip 220. In some embodiments, the shield 212 is connected to the body 202 by heat staking, although other suitable methods may be alternatively employed.

In some embodiments, the top surface 216 of the shield 212 may contact an associated one of the printheads 104 during spitting so as to form a seal about printhead 212. Pursuant to these embodiments, the printhead spits ink or other fluid into the cavity 208 while the shield 212 is in contact with the printhead 104. In this configuration, the shield 212 may reduce aerosol from escaping the cavity 208 during the spitting operation.

In other embodiments, the top surface 216 of shield 212 is positioned closely to the printhead 104 during spitting, but is spaced from the printhead 104 such that the printhead 104 and the shield 212 do not contact during spitting. The close proximity of the printhead 104 and the top surface 216 of shield 212 during spitting may reduce aerosol from escaping the cavity 208 during the spitting operation.

Figure 3:
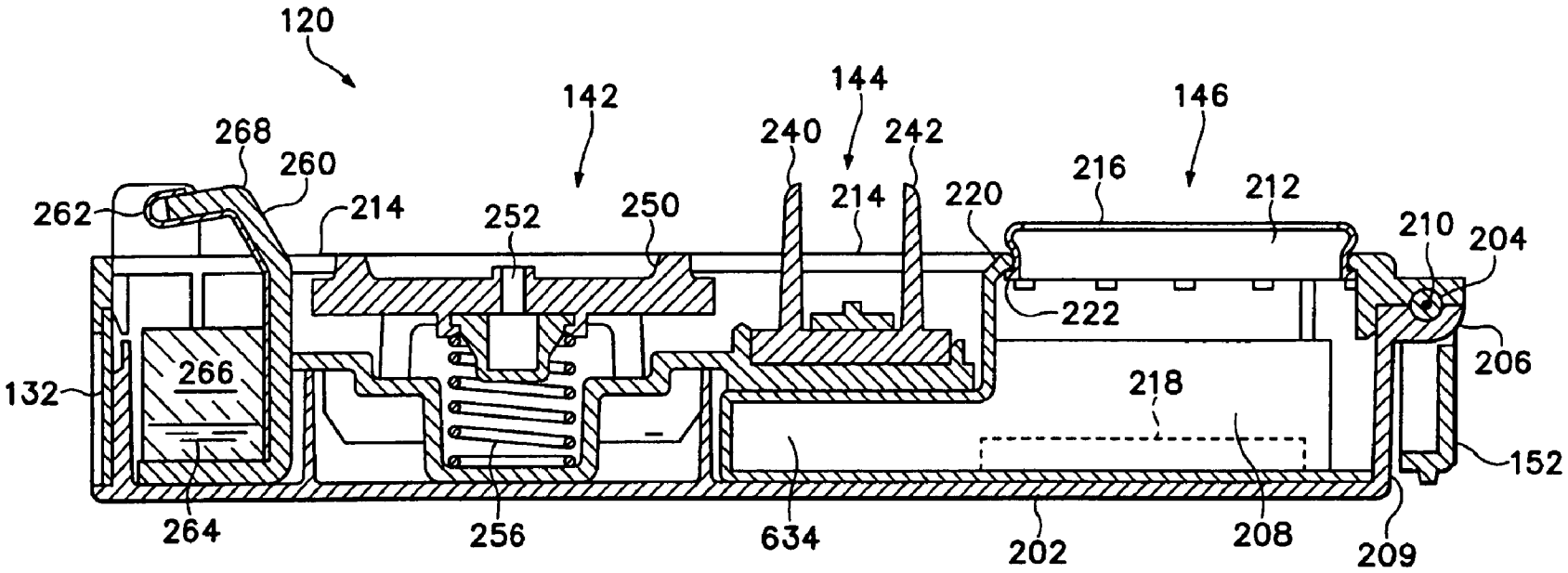
FIG. 3 is a sectional view of the printhead cleaner of FIG. 2 according to an example embodiment.

The wiping station 144 may comprise one or more wipers. In the embodiment shown in FIGS. 2-5, the wiping station 144 includes first and second wipers 240, 242. As shown in FIG. 2, the wiper 240 may be wider than the wiper 242. In some embodiments, the wiper 240 may be used to wipe a large width of a printhead and the wiper 242 may be used to wiper a smaller width of the printhead, such as the width of the printhead that corresponds with the positions of the fluid-ejecting nozzles (not shown). The wipers 240, 242 may be formed as discrete members or may be integrally formed as shown in FIG. 3.

The capping device 142 may comprise a cap 250 having vent hole 252. The cap 250 may be supported by resilient member 256, which may comprise a spring as shown in FIG. 3. The resilient member 256 may be used to bias the cap 250 against a printhead 104 during capping.

An absorbent member 260 is positioned at retaining member 262. The absorbent member 260 wicks wipe assisting fluid 264 disposed in reservoir 266 from the reservoir 266 to a contact region 268. Pursuant to some embodiments, the retaining member 262 is a spring that biases the absorbent member 260 away from the surface 214. In this configuration, as the printhead cleaner 120 moves adjacent a corresponding printhead 104, the absorbent member 260 contacts the printhead 104 and transfers wipe assisting fluid to the printhead 104. The wipe assisting fluid 264 may comprise, for example, PEG (polyethylene glycol), LEG (lipponic-ethylene glycol), DEG (Diethylene glycol), glycerin, a hygroscopic wipe assisting fluid, or other suitable wipe assisting fluid.

Figure 6:
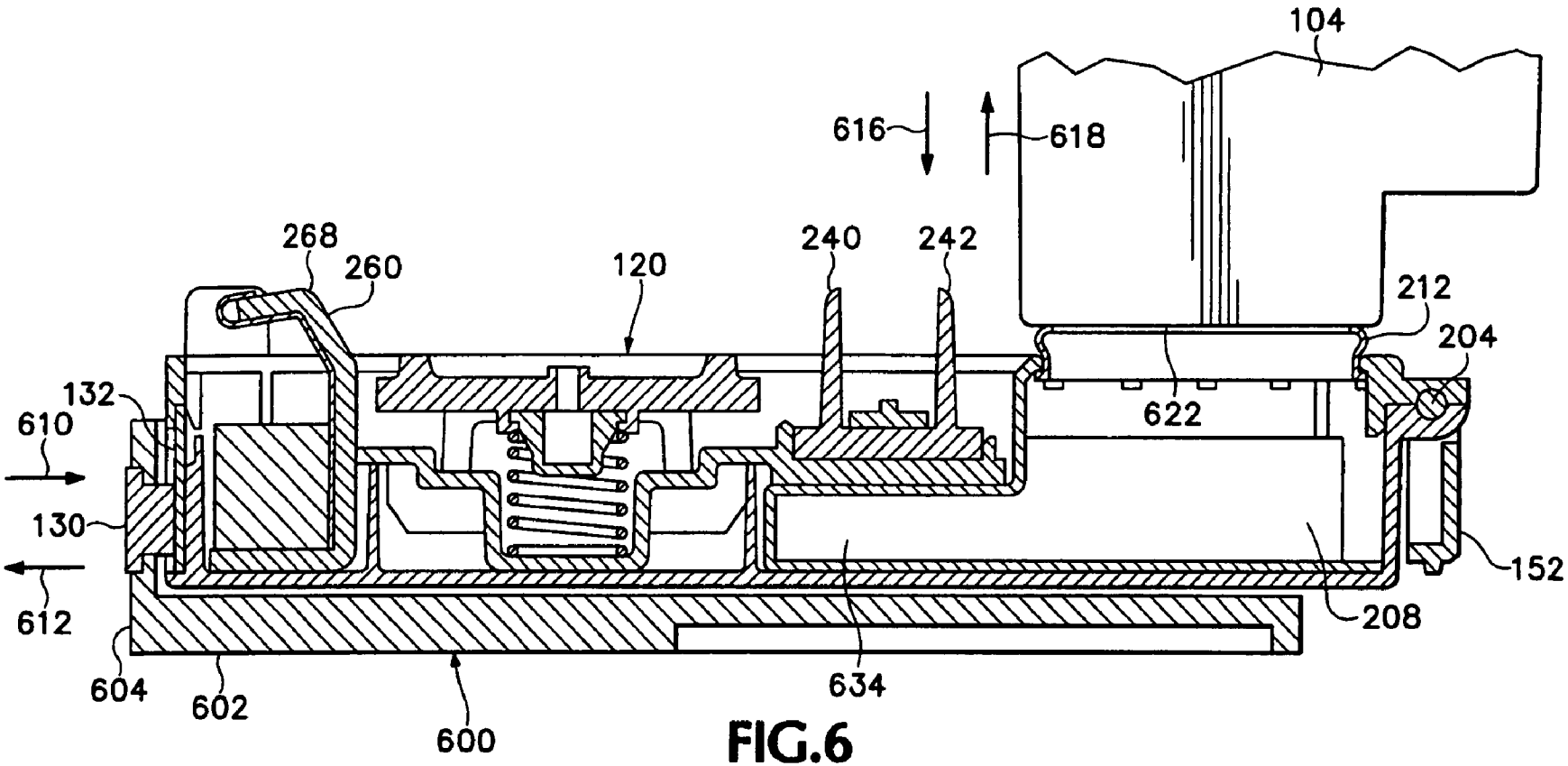
FIG. 6 is a sectional view of the printhead cleaner of FIG. 2, a portion of a carriage, and an associated printhead, according to an example embodiment.

FIG. 6 illustrates the printhead cleaner 120, a portion of a carriage 600, and a printhead 104, in accordance with an example embodiment. As shown, the printhead cleaner 120 is coupled to the carriage 600 by magnetic force between members 130 and 132. The carriage 600 includes a base portion 602 and a support portion 604 that is generally orthogonal to the base portion 602. The member 130 is positioned at and may be supported by the support portion 604 of the carriage 600.

An example embodiment of printhead 104 is shown in FIG. 6 as being aligned with the spitting station 146 and in contact with the shield 212. In this position, the printhead 104 may spit fluid into the cavity 208. The shield 212, in some embodiments, reduces or prevents aerosol from escaping the cavity 208.

In some embodiments, as the carriage 600 and printhead cleaner 120 move in directions 610, 612, the printhead 104 may move in directions 616, 618 to engage and disengage surface 622 of the printhead 104 with one or more printhead elements. For example, the printhead 104 may move into contact with the cap 250 and into wiping contact with the wipers 240, 242.

Pursuant to an example embodiment, during a servicing operation, the printhead cleaner 120 moves in direction 612 toward an associated printhead 104 and the printhead 104 moves in direction 612 so that the surface 622 of the printhead 104 contacts contact region 268 of the wick 260. The contact region 268 of the wick 260 applies, or transfers, wipe assisting fluid from the wick to the surface 622 of the printhead 104. The surface 622 of the printhead 104 may have an array of fluid-ejecting nozzles formed therein. The printhead cleaner 120 continues to move in the direction 612 so the surface 622 of the printhead 104 contacts one or more of the wipers 240, 242. In some embodiments, the printhead 104 may also move in one of the directions 616, 618 so as to contact the wipers 240, 242 at a desired location. The printhead cleaner 120 then moves in the direction 612 to the position shown in FIG. 6. The printhead 104 may move in one of the directions 616, 618 so that it contacts or almost contacts the shield 212. In the position shown in FIG. 6, the printhead 104 performs a spitting operation by ejecting fluid from the printhead 104 into the cavity 208. After the printhead 104 performs the spitting operation, the printhead cleaner 120 may move in direction 610 to align the printhead 104 with the capping device 250 for capping. To engage the capping device 250, the printhead 104 may move in the direction 616. Alternatively, the printhead cleaner may continue to move in the direction 612 until the printhead cleaner 120 is outside of the print zone.

Although the foregoing has been described with reference to example embodiments, workers skilled in the art will recognize that changes may be made in form and detail without departing from the spirit and scope thereof. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present subject matter described with reference to the example embodiments and set forth in the following claims is manifestly intended to be as broad as possible. For example, unless specifically otherwise noted, the claims reciting a single particular element also encompass a plurality of such particular elements.

What is claimed is:

1. An image forming device comprising:
- a carriage;
- a printhead cleaner disposed at the carriage;
- a magnet disposed at either the carriage or the cleaner for securing the printhead cleaner at the carriage by magnetic force;
- a spittoon cavity formed in a body and having an opening;
- a compliant shield formed about the opening.

2. The image forming device according to claim 1, wherein the magnet is disposed at the carriage and a magnetic material plate is positioned at the printhead cleaner.

3. The image forming device of claim 1, wherein the magnet is disposed at the cleaner and a magnetic material plate is disposed at the carriage.

4. The image forming device of claim 1, further comprising:
- a capping device;
- an elastomeric shield formed about the opening,
- a printhead configured to move into contact with the elastomeric shield such that the elastomeric shield forms a seal about the printhead.

5. The image forming device of claim 4, wherein the printhead is configured to perform a spitting operation while in contact with the elastomeric shield.

6. The image forming device of claim 1, wherein a folding handle is coupled to the printhead cleaner.

7. The image forming device of claim 1, wherein the magnet is disposed in the carriage, further comprising:
- a magnetic material plate is positioned at a first end of the printhead cleaner;
- a folding handle positioned at a second end of the printhead cleaner, the second end of the printhead cleaner being opposite the first end of the printhead cleaner.

8. The image forming device of claim 1, further comprising:
- a reservoir containing a hygroscopic wipe assisting fluid;
- a wick in fluid communication with the reservoir such that the wick draws at least some of the hygroscopic wipe assisting fluid;
- a bias member configured to bias the wick away from the reservoir to press against a printhead.

9. The image forming device of claim 1, further comprising:
- an array of printheads;
- the carriage being configured to move one or more printhead cleaners into alignment with the printheads for servicing the printheads.

10. The image forming device of claim 1, wherein the printhead cleaner comprises:
- a body having opposing first and second ends;
- a magnetic material plate disposed at the first end for providing magnetic attraction to the magnet, the magnet disposed at the carriage;
- a capping device coupled to the body;
- a wick in fluid communication with a wipe assisting fluid reservoir and disposed between the capping device and the first end;
- a cavity formed in the body adjacent the second end, the cavity having an opening;
- an elastomeric shield positioned about the opening;
- first and second wipers coupled to the body between the shield and the capping device;
- a handle pivotally coupled to the body at the second end.

11. The image forming device of claim 10, wherein the body has opposing side walls extending between the first and second ends, the body further comprising grooves formed in the opposing sidewalls for accepting protrusions in the carriage for securing the body to the carriage.

12. A printhead cleaner comprising:
- a cap mounted on a body;
- a cavity formed in the body and having an opening;
- a shield formed about the opening;
- one or more wipers mounted on the body between the cap and the shield;
- a handle pivotally attached to one end of the body;
- a member formed of a magnetic material disposed at an opposite end of the body.

13. The printhead cleaner of claim 12, wherein the shield is formed of rubber.

14. The printhead cleaner of claim 12, wherein the shield is formed of EPDM.

15. The printhead cleaner of claim 12, wherein the shield is formed of a material having a Shore A Scale hardness in the range of 35-80.

16. The printhead cleaner of claim 12, wherein the shield is formed of a material having a Shore A Scale hardness in the range of 70-80.

17. The printhead cleaner of claim 12, wherein the shield contacts a printhead during servicing.

18. The printhead cleaner of claim 12, further comprising:

a reservoir formed in the body adjacent the member formed of magnetic material;

a wick at least partially disposed in the reservoir;

a bias member supporting at least a portion of the wick.

19. A printhead cleaner comprising:

a capping device coupled to a body;

one or more wipers coupled to the body;

a handle coupled to the body, the handle being rotatable relative to the body;

wherein the handle is coupled to the body at a first end and a magnet or a magnetic member is disposed at a second end of the body, the second end being opposite the first end.

20. The printhead cleaner of claim 19, further comprising:

a spittoon having an opening;

a rubber member disposed about the opening.

21. A printhead cleaner comprising:

a capping device coupled to a body;

one or more wipers coupled to the body;

a cavity formed in the body and having an opening;

an rubber shield coupled to the body and disposed around the opening;

a magnet or a magnetic member coupled to a first end of the body;

a handle pivotally coupled to a second end of the body, the second end being opposite the first end;

a reservoir adjacent the first end of the body;

a wick at least partially disposed in the reservoir.

22. The printhead cleaner of claim 21, wherein the one or more wipers are disposed between the capping device and the rubber shield.

23. The printhead cleaner of claim 22, wherein the wick is positioned between the capping device and the first end of the body.

24. The printhead cleaner of claim 23, wherein the shield is disposed between the handle and the one or more wipers.

25. The printhead cleaner of claim 21, wherein the rubber comprises EPDM.

26. The printhead cleaner of claim 21, wherein the rubber has a Shore A Scale hardness in the range of 35-80.

27. An apparatus, comprising:

a carriage;

a printhead cleaner having a spittoon cavity with an opening;

a compliant shield formed about the opening;

means for magnetically securing the printhead cleaner to the carriage.

* * * * *